US006479107B2

(12) United States Patent
Katagiri et al.

(10) Patent No.: US 6,479,107 B2
(45) Date of Patent: Nov. 12, 2002

(54) METHOD FOR COATING A RUNNING WEB WITH A PLURALITY OF COATING LAYERS

(75) Inventors: Yoshinobu Katagiri, Minami-Ashigara (JP); Kazuhiro Oki, Tokyo (JP); Yasuhiko Tokimasa, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/756,183

(22) Filed: Jan. 9, 2001

(65) Prior Publication Data

US 2001/0008653 A1 Jul. 19, 2001

(30) Foreign Application Priority Data

Jan. 14, 2000 (JP) ..... 2000-006695

(51) Int. Cl.[7] ..... B05D 1/34
(52) U.S. Cl. ..... 427/414; 427/402; 427/420
(58) Field of Search ..... 427/420, 402, 427/414; 118/DIG. 4, 411

(56) References Cited

U.S. PATENT DOCUMENTS 4,113,903 A 9/1978 Choinski ..... 427/420
4,569,863 A 2/1986 Koepke et al. ..... 427/402

FOREIGN PATENT DOCUMENTS

| | | | |
|---|---|---|---|
| DE | A1 32 41 831 | 5/1984 | B05D/7/04 |
| EP | A1 0 017 126 | 10/1980 | G03C/1/74 |
| EP | A2 0 930 530 | 7/1999 | G03C/1/74 |
| JP | 54-1350 | 1/1979 | B05D/1/36 |
| JP | 56-108566 | 8/1981 | B05D/1/34 |
| JP | 59-100435 | 6/1984 | G03C/1/74 |
| JP | 60-12107 | 3/1985 | B05D/1/36 |
| JP | 4-10053 | 2/1992 | G03C/1/74 |
| JP | 11-197589 | 7/1999 | B05D/1/30 |

*Primary Examiner*—Katherine A. Bareford
(74) *Attorney, Agent, or Firm*—Sughrue Mion, PLLC

(57) ABSTRACT

In a simultaneous coating of multiple layers on a web using a slide hopper type coating apparatus, the gelatin concentration of the coating liquid for the bottom layer is set to be lower than the gelatin concentration of the coating liquid for the middle layer by at least 2 points in percentage, the ratio A/B, which is the flow amount ratio of the coating liquid for the bottom layer with respect to the entire multi-layered coating liquid, is set to be between 0.05 and 0.2, and the ratio C/D, which is the viscosity ratio between the coating liquid for the bottom layer and the coating liquid of the middle layer, is set to be between 0.2 and 0.67. Thereby, the flow of the multi-layered coating liquid flowing down on the slide surface can be stabilized.

6 Claims, 3 Drawing Sheets

FIG. 3

| | LAYER 1 BOTTOM | LAYER 2 MIDDLE | LAYER 3 TOP | DIFFERENCE IN GELATIN CONCENTRATION $C_2-C_1$ | VISCOSITY RATIO $\eta_1/\eta_2$ | FLOW AMOUNT RATIO $q_1/q_{total}$ | QUALITY OF COATED SURFACE |
|---|---|---|---|---|---|---|---|
| COMPARATIVE EXAMPLE 1 | $C_1$ 10%<br>$\eta_1$ 100mPa·s<br>$q_1$ 1cc/cm·s | $C_2$ 10%<br>$\eta_2$ 100mPa·s<br>$q_2$ 3cc/cm·s | $C_3$ 10%<br>$\eta_3$ 50mPa·s<br>$q_3$ 1cc/cm·s | 0% | 1 | 0.2 | ENTRAINED AIR EFFECT INVOLVING ACCUMULATED LIQUID OCCURRED |
| COMPARATIVE EXAMPLE 2 | $C_1$ 6%<br>$\eta_1$ 70mPa·s<br>$q_1$ 1cc/cm·s | $C_2$ 10%<br>$\eta_2$ 100mPa·s<br>$q_2$ 3cc/cm·s | $C_3$ 10%<br>$\eta_3$ 50mPa·s<br>$q_3$ 1cc/cm·s | 4% | 0.7 | 0.2 | BARRING UNEVENNESS OCCURRED |
| COMPARATIVE EXAMPLE 3 | $C_1$ 6%<br>$\eta_1$ 15mPa·s<br>$q_1$ 1cc/cm·s | $C_2$ 10%<br>$\eta_2$ 100mPa·s<br>$q_2$ 3cc/cm·s | $C_3$ 10%<br>$\eta_3$ 50mPa·s<br>$q_3$ 1cc/cm·s | 4% | 0.15 | 0.2 | NO BARRING UNEVENNESS, BUT MANY STREAKS OCCURRED |
| COMPARATIVE EXAMPLE 4 | $C_1$ 6%<br>$\eta_1$ 50mPa·s<br>$q_1$ 2cc/cm·s | $C_2$ 10%<br>$\eta_2$ 100mPa·s<br>$q_2$ 3cc/cm·s | $C_3$ 10%<br>$\eta_3$ 50mPa·s<br>$q_3$ 1cc/cm·s | 4% | 0.5 | 0.4 | NO BARRING UNEVENNESS, BUT MOTTLING UNEVENNESS OCCURRED |
| COMPARATIVE EXAMPLE 5 | $C_1$ 6%<br>$\eta_1$ 50mPa·s<br>$q_1$ 0.2cc/cm·s | $C_2$ 10%<br>$\eta_2$ 100mPa·s<br>$q_2$ 3cc/cm·s | $C_3$ 10%<br>$\eta_3$ 50mPa·s<br>$q_3$ 1cc/cm·s | 4% | 0.5 | 0.04 | BARRING UNEVENNESS OCCURRED & LEVELING UNEVENNESS CLEARLY OBSERVED |
| EXAMPLE 1 | $C_1$ 6%<br>$\eta_1$ 50mPa·s<br>$q_1$ 0.8cc/cm·s | $C_2$ 10%<br>$\eta_2$ 100mPa·s<br>$q_2$ 3.2cc/cm·s | $C_3$ 10%<br>$\eta_3$ 50mPa·s<br>$q_3$ 1cc/cm·s | 4% | 0.5 | 0.16 | SATISFACTORY |
| EXAMPLE 2 | $C_1$ 4%<br>$\eta_1$ 30mPa·s<br>$q_1$ 0.5cc/cm·s | $C_2$ 10%<br>$\eta_2$ 100mPa·s<br>$q_2$ 3.5cc/cm·s | $C_3$ 10%<br>$\eta_3$ 50mPa·s<br>$q_3$ 1cc/cm·s | 6% | 0.3 | 0.1 | SATISFACTORY |
| EXAMPLE 3 | $C_1$ 6%<br>$\eta_1$ 80mPa·s<br>$q_1$ 0.5cc/cm·s | $C_2$ 10%<br>$\eta_2$ 120mPa·s<br>$q_2$ 1cc/cm·s | $C_3$ 10%<br>$\eta_3$ 50mPa·s<br>$q_3$ 3cc/cm·s | 4% | 0.67 | 0.11 | SATISFACTORY |

METHOD FOR COATING A RUNNING WEB WITH A PLURALITY OF COATING LAYERS

BACKGROUND OF THE INVENTION

1. Field of the Invention

The present invention relates generally to a coating method, more particularly to a coating method using a slide hopper type coating apparatus with a slide surface in manufacturing a film for photosensitive material, photographic printing paper, and so forth, in which multiple liquid coating compositions (hereunder called "coating liquid") including gelatin are applied to a web that runs continuously so as to make multiple layers on the web.

2. Description of Related Art

A slide hopper type coating apparatus is one of the apparatuses which coat coating liquid on a running web surface; roughly classifying coatings of such apparatuses, there are slide bead type coating and a slide curtain coating. The slide hopper type coating apparatus has a superior coating capability in a case of simultaneously coating of a plurality of coating liquids on the web at a high speed, and is widely used in manufacturing a film of photosensitive material and photographic printing paper.

In order to attain a coated surface in a satisfactory quality by the use of the slide hopper type coating apparatus, stabilizing a flow of the multiple layered coating liquid flowing down on the slide surface is essential. In a slide bead coating, forming a stable bead is essential, and in a slide curtain coating, eliminating the entrained air effect is essential. Therefore, designing coating liquid composition to satisfy the above conditions is necessary.

Conventionally, a number of measures have been attempted to achieve the above conditions. For example, Japanese Patent Publication No. 4-10053 suggests preventing the entrained air effect in the high-speed coating by lowering the viscosity of the substratum layer (bottom layer) next to the web when being coated. Japanese Patent Publication No. 60-12107 suggests designing composition of the coating liquid so that the viscosity is low when a shearing that is the same as one with the bead is applied in the slide bead coating. Japanese Patent Application Laid-open Nos. 56-108566 and 11-197589 suggest reducing a difference in viscosity between the coating liquid for the bottom layer and the coating liquid for the middle layer in a low shearing by adding thickener, because instability such as ruffles often occurs in the multi-layered coating liquid that flows down on the slide surface when using the coating liquid that is low in viscosity to the bottom layer with respect to the slide surface.

In most of the contents of the above-mentioned prior arts, it has been attempted to improve the coating quality by lowering the viscosity of the coating liquid for the bottom layer in a high shearing while stabilizing the multi-layered coating liquid flowing down on the slide surface by making the viscosity of the coating liquid for the bottom layer similar to the other layers in the low shearing.

However, if the compositions of the coating liquid for the bottom layer and the coating liquid for the middle layer differ, and specially if both of the coating liquids for the bottom layer and the middle layer contain gelatin and the difference in the gelatin concentration of the coating liquids of both layers is large, or, if the maximum inclination angle of the slide surface is at least 40 degrees, that is, the condition in which the flow of the multi-layered coating liquid on the slide surface is often unstable, the instability such as ruffles cannot be prevented by merely applying the conventional technique, and thus the coated surface with a satisfactory quality cannot be obtained.

In such condition, stabilizing the flow of the multi-layered coating liquid on the slide surface is not enough to attain a coated surface with a satisfactory quality; as described above, in the slide bead coating, forming a stable bead is necessary, and in the slide curtain coating, preventing the entrained air effect in the high-speed coating is also necessary.

SUMMARY OF THE INVENTION

The present invention has been developed in view of the above-described circumstances, and has as its object the provision of a coating method which can attain a coated surface with a satisfactory quality even in a condition where the flow of the multi-layered coating liquid is often unstable.

In order to achieve the above-described objects, the present invention is directed to a coating method in which a running web is coated with a plurality of coating liquids by a slide hopper type coating apparatus with a slide surface on which the plurality of coating liquids flow down to form a plurality of coating layers on the web, wherein: at least two of the plurality of coating liquids for a bottom layer and a layer next to the bottom layer with respect to the slide surface contain gelatin; a gelatin concentration of the coating liquid for the bottom layer is set to be lower than a gelatin concentration of the coating liquid for the layer next to the bottom layer by at least 2 points in percentage; and the plurality of coating liquids are prepared such that a ratio A/B is not less than 0.05 and not more than 0.2 and a ratio C/D is not less than 0.2 and not more than 0.67, where A is a flow amount per width of the coating liquid for the bottom layer on the slide surface, B is a flow amount per width of the whole of the plurality of coating liquids on the slide surface, C is a viscosity of the coating liquid for the bottom layer, and D is a viscosity of the coating liquid for the layer next to the bottom layer.

The present invention is derived from the knowledge that a coated surface with a satisfactory quality can be attained by setting the viscosity of the coating liquid for the bottom layer in the low shearing to be lower than the coating liquid for the middle layer and at the same time selecting an appropriate flow amount ratio of the coating liquid for the bottom layer with respect to the entire multi-layered coating liquid, even though under the conditions that the flow of the multi-layered coating liquid on the slide surface tends to be unstable where the gelatin concentration of the coating liquid for the bottom layer is low and the slide angle of the slide surface is large. According to the present invention, the gelatin concentration of the coating liquid for the bottom layer is set to be lower than the gelatin concentration of the coating liquid for the middle layer by at least 2 points in percentage, the ratio A/B, which is the flow amount ratio of the coating liquid for the bottom layer with respect to the entire multilayered coating liquid, is set to be between 0.05 and 0.2, and the ratio C/D, which is the viscosity ratio between the coating liquid for the bottom layer and the coating liquid of the middle layer, is set to be between 0.2 and 0.67. Thereby, the flow of the multi-layered coating liquid flowing down on the slide surface can be stabilized.

Preferably, the slide surface has a portion of a maximum inclination angle of not less than 40 degrees with respect to the level. According to the present invention, the multi-layered coating liquid flowing down on the slide surface can have an appropriate flow speed, and moreover the flow of the multi-layered coating liquid on the slide surface can be stabilized.

Preferably, a length of the portion of the slide surface of the maximum inclination angle of not less than 40 degrees is not more than 10 cm. According to the present invention, the flow of the multi-layered coating liquid on the slide surface can be even more easily stabilized while providing the appropriate flow speed to the multi-layered coating liquid flowing down on the slide surface.

Preferably, the gelatin concentration of the coating liquid for the bottom layer is not less than 3% and not more than 8%. According to the present invention, the flow of the multi-layered coating liquid on the slide surface can be even more easily stabilized.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 3 is a table showing examples of the present invention and comparative examples.

DETAILED DESCRIPTION OF THE PREFERRED EMBODIMENT

Hereunder preferred embodiment of a coating method of the present invention will be described in accordance with the accompanying drawings.

First, a slide hopper type coating apparatus to which the coating method of the present invention is applied is described with an example of simultaneously coating with three layers.

Figure 1:
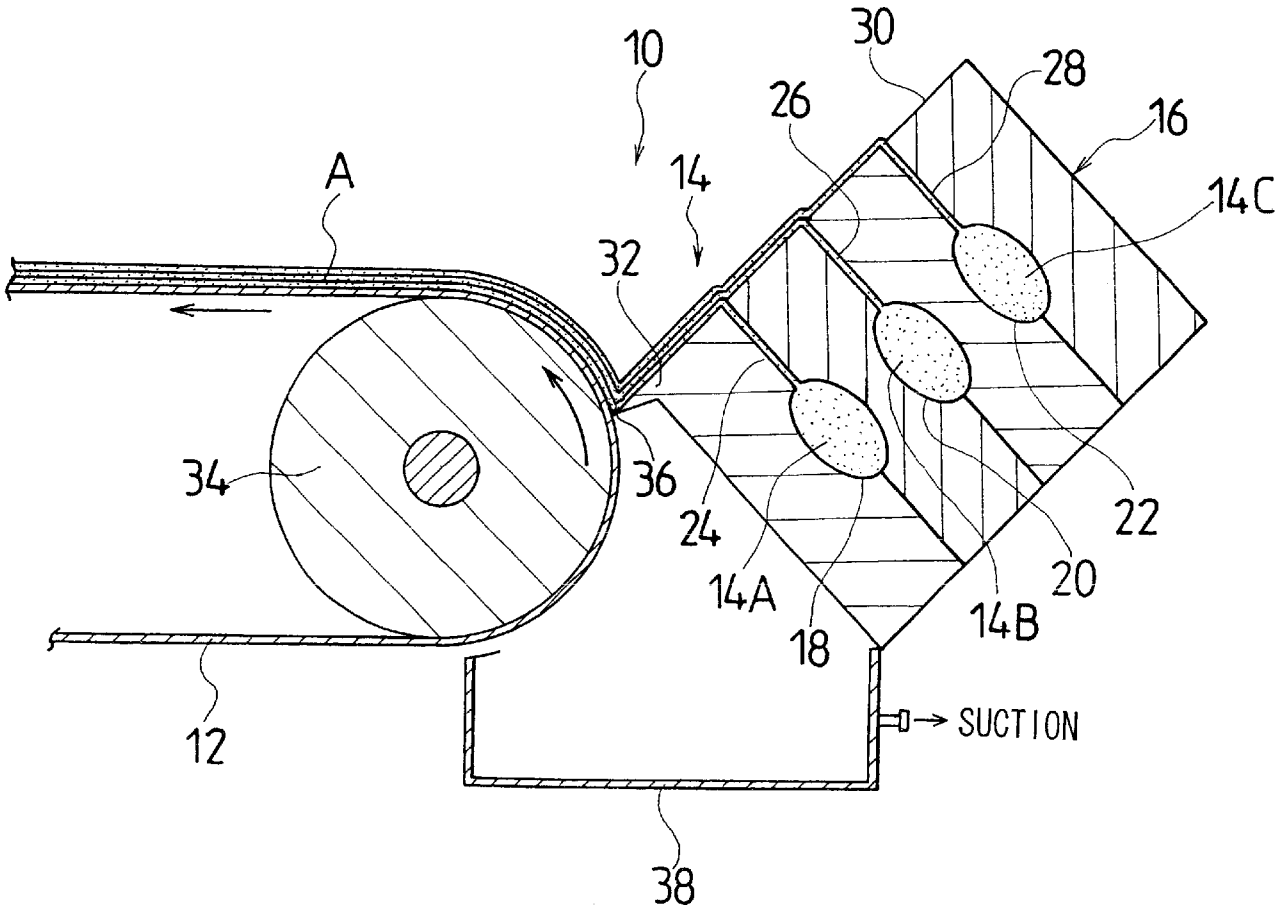
FIG. 1 is a section view for illustrating a slide bead coating apparatus to which a coating method of the present invention is applied.

A slide bead coating apparatus, which is one of the slide hopper type coating apparatus, is shown in FIG. 1.

As seen from FIG. 1, a plurality (e.g., three) of types of coating liquids 14A, 14B and 14C to coat a web 12 are supplied from respective coating liquid tanks (not shown) through respective liquid supply pumps, which can change flow amounts, to respective manifolds 18, 20 and 22 in a slide hopper 16 for a bead coating. The coating liquids 14A, 14B and 14C that are supplied to the manifolds 18, 20 and 22 are widened in the direction of the coating width so as to be a predetermined coating width, and are extruded through respective slots 24, 26 and 28 in slit shapes onto a slide surface 30, which is the top face of the slide hopper 16 and is inclined downward. The coating liquids 14A, 14B and 14C that have been extruded on the slide surface 30 now become a multi-layered coating liquid 14 having multi-layered coating films. The multi-layered coating liquid 14 flows down on the slide surface 30, and reaches at a lip end 32 at the bottom end of the slide surface 30. The multi-layered coating liquid 14 having reached at the lip end 32 forms a bead 36 between the lip end 32 and the surface of the web 12, which is wound on a backup roller 34 and fed. At this point, the pressure of the bottom side of the bead 36 is reduced by a suction chamber 38 so as to stabilize the bead 36. At the bead 36, the web 12 runs from the bottom to the top along the periphery of the backup roller 34, whereby the multi-layered coating liquid 14 at the bead 36 receives an action to be pulled up on the surface of the web 12, extends, and becomes a thinner film. As a result, a multi-layered coating film A composed of thin layers is formed on the surface of the running web 12. In this process described in the embodiments of the present invention, the reference number 14A is the coating liquid forming the bottom layer with respect to the slide surface 30, the reference number 14B is the coating liquid forming the next (the middle) layer, and the reference number 14C is the coating liquid forming the top layer; they are the same in a coating with a slide curtain type coating apparatus, which will be described next.

Figure 2:
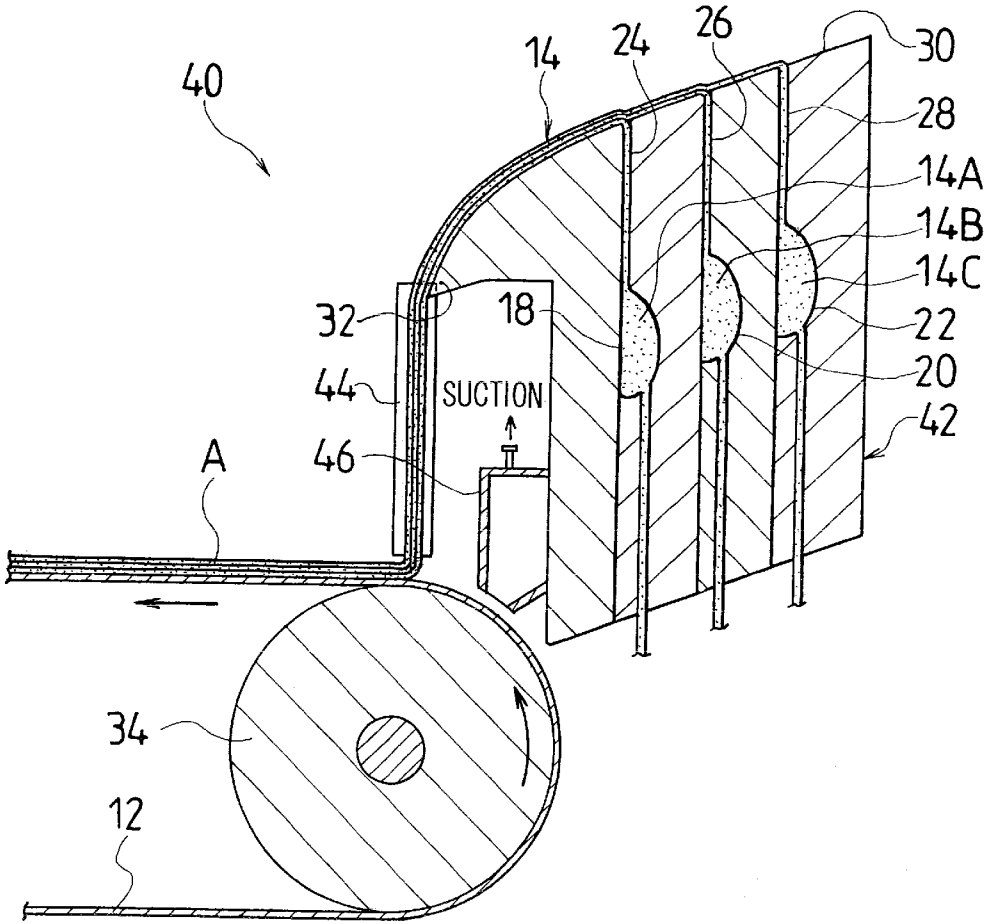
FIG. 2 is a section view for illustrating a slide curtain coating apparatus to which the coating method of the present invention is applied.

FIG. 2 shows the slide curtain coating apparatus 40, which is one of the slide hopper type coating apparatus. The same members as the ones mentioned in the slide bead type coating apparatus in FIG. 1 are assigned the same numbers.

As seen from FIG. 2, the plurality (e.g., three) of types of coating liquids 14A, 14B and 14C to coat the web 12 are supplied from the respective coating liquid supply tanks (not shown) through the respective liquid supply pumps, which can change flow amounts, to the respective manifolds 18, 20 and 22 in a slide hopper 42 for a curtain coating. The respective coating liquids 14A, 14B and 14C that are supplied to the manifolds 18, 20 and 22 are widened in the direction of the coating width so as to be a predetermined coating width, and are extruded through respective slots 24, 26 and 28 in slit shapes onto a slide surface 30, which is the top face of the slide hopper 16 and is inclined downward. The coating liquids 14A, 14B and 14C that have been extruded on the slide surface 30 now become the multi-layered coating liquid 14. The multi-layered coating liquid 14 flows down on the slide surface 30, and reaches at the lip end 32 at the bottom end of the slide surface 30. The multi-layered coating liquid 14 having reached at the lip end 32 falls freely in a form of a curtain film, and collides on the surface of the web 12, which is wound on the backup roller 34 and fed. When the multi-layered coating liquid 14 collides on the surface of the web 12, the coating liquid 14 is pulled and becomes thinner, and extends to form the multi-layered coating film A. At this point, the edges of both sides of the curtain film are guided by a pair of edge guides 44 and 44 (only one of which is shown in FIG. 2), which are disposed at the edges of both sides of the curtain film. An air suction and shielding unit 46 is disposed at the upstream side in the web running direction with respect to the colliding point of the web 12 and the curtain film. The air suction and shielding unit 46 reduces the air entrained by the running web 12 to form a stable curtain film so as to stabilize the coating.

In order to provide an appropriate flow down speed of the multi-layered coating liquid 14, which flows down on the slide surface 30, both the slide bead coating apparatus 10 and the slide curtain coating apparatus 40 have the slide surface 30 with the maximum inclination angle of at least 40 degrees with respect to the level, and the length of the portion of the slide surface inclined by at least 40 degrees is set to be at most 10 cm.

The web 12 used in the present invention may include paper, plastic film, resin coated paper, synthetic paper, and so forth. The material of the plastic film may be polyolefin, polyester, cellulose acetate, and so forth, and the material of the resin used for the resin coated paper may be polyolefin such as polyethylene; however, the material is not limited to them. Further, any of the above-mentioned web may has a substratum.

The coating liquid used for the present invention may contain emulsion of photosensitive material, surfactant, viscosity enhancer of polymer, and so forth. At least the coating liquid 14A for the bottom layer and the coating liquid 14B for the middle layer contain gelatin.

Next, the coating method of the present invention will be described using the slide bead coating apparatus 10 or the slide curtain coating apparatus 40, which are constructed as described above.

In the coating method of the present invention, the coating liquid 14A for the bottom layer, the coating liquid 14B for the middle layer, and the coating liquid 14C for the top layer are prepared so as to satisfy the following predetermined conditions, and are supplied to the manifolds 18, 20 and 22 of the slide hoppers 14 or 42.

The first condition is that the coating liquids 14A and 14B for the bottom and the middle layer are solutions containing gelatin, in which the gelatin concentration of the coating liquid 14A for the bottom layer is lower than the gelatin concentration of the coating liquid 14B for the middle layer by at least 2 points in percentage (i.e., if the gelatin concentration of the coating liquid 14B for the middle layer is 10% for example, the gelatin concentration of the coating liquid 14A for the bottom layer is not more than 8%). In this case, the coating liquids 14A and 14B for the bottom and the middle layers may contain the emulsion of the photosensitive material, surfactant, polymer viscosity-enhancer, and so forth. By setting the gelatin concentration of the coating liquid 14A for the bottom layer to be lower than the gelatin concentration of the coating liquid 14B for the middle layer by at least 2 points in percentage as described above, a sturdy and stable bead 36 can be formed in a case of the slide bead coating, and the disturbance by the entrained air can be prevented in a case of the slide curtain coating.

The second condition is that the respective coating liquids are set such that the ratio A/B is not less than 0.05 and not more than 0.2 and the ratio C/D is not less than 0.2 and not more than 0.67, where A is the flow amount per width of the coating liquid 14A for the bottom layer on the slide surface 30, B is the flow amount per width of the entire multi-layered coating liquid on the slide surface 30, C is the viscosity of the coating liquid 14A for the bottom layer, and D is the viscosity of the coating liquid 14B for the middle layer. If the difference of the gelatin concentrations between the coating liquid 14A for the bottom layer and the coating liquid 14B for the middle layer is set to be large, the multi-layered coating liquid 14 is often unstable; however, by preparing the coating liquids 14A, 14B and 14C so as to satisfy the conditions of the flow amount ratio and the viscosity ratio, instability of the multi-layered coating liquid 14 can be reduced due to the speed differences at the layer boundaries in flowing of the coating liquid 14 when the coating liquids 14A, 14B and 14C are flowing down on the slide surface 30 by gravity, and thereby the mixing and ruffles between the coating liquids are avoided. Thus, the flow of the multi-layered coating liquid 14 flowing down on the slide surface 30 can be stabilized.

Accordingly, even under the conditions where the multi-layered coating liquid 14 on the slide surface 30 tends to be unstable, that the maximum inclination angle of the slide surface 30 of the slide hoppers 16 and 42 is at least 40 degrees and the gelatin concentration of the coating liquid 14A for the bottom layer is lower than the gelatin concentration of the coating liquid 14B for the middle layer by at least 2 points in percentage, a coating surface with a satisfactory quality can still be attained on the web 12 coated with the multilayered coating liquid.

Preferably, when preparing the coating liquids 14A, 14B and 14C for the bottom layer, middle layer and top layer, respectively, the gelatin concentration, viscosity, and flow amount of the coating liquid 14A for the bottom layer are determined first. Then, the coating liquids 14B and 14C for the middle layer and the top layer are secondly prepared so as to satisfy the first and the second conditions by referring to the determined gelatin concentration, viscosity, and flow amount of the coating liquid 14A for the bottom layer. In this case, the gelatin concentration of the coating liquid 14A for the bottom layer as the reference is preferably set to be not less than 3% and not more than 8%.

EXAMPLES

Examples of the present invention and comparative examples with the slide curtain coating apparatus that performed three layer coating shown in FIG. 2 will be described with reference to FIG. 3.

The slope of the slide hopper was made such that the inclination angle of the slide surface was gradually increased from 20 degrees at the upstream of the flow direction of the coating liquid up to the maximum angle of 45 degrees, and the length of the slide surface on which the inclination angle was 40 degrees or more was approximately 5 cm.

The coating liquid was an aqueous solution of gelatin treated with alkali, to which polystyrene sulfonate was added as a viscosity enhancer so as to adjust the viscosity, and surfactant and dye were further added as required. With the composition, the examples 1–3 that satisfied the above-mentioned first and the second conditions, and the comparative examples 1–5 that did not satisfy the first and the second conditions were prepared. The values indicating the gelatin concentration (C %), viscosity (ηmPa·s), and flow amount per width (q $cm^3$/cm·sec) are shown in FIG. 3. The viscosity was measured with the Brookfield viscometer.

The length of the curtain was 15 cm that fell freely from the top end of the lip of the slide hopper to the web, and the web was coated while running at 400m/min. The web was resin coated paper on which gelatin was pre-coated as subbing layer.

After that, the existence of the entrained air effect in the coating, and the coating qualities such as the existence of"barring unevenness" on the coated surface of the web coated with the multi-layered coating liquid were evaluated by visual observation.

The results are shown in FIG. 3.

As apparent from FIG. 3, the comparative example 1 was a case where the flow amount ratio satisfied the condition of the present invention but the difference between the gelatin concentrations and the viscosity ratio did not satisfy the conditions of the present invention; in such state, since the gelatin concentration of the coating liquid for the bottom layer was too high, the quality of the high-speed coating was inferior with occurrence of the entrained air effect involving accumulated liquid.

The comparative example 2 was a case where the difference of the gelatin concentrations and the flow amount ratio satisfied the conditions of the present invention but the viscosity ratio was over the maximum limit of the present invention; in such state, ruffles occurred on the slide surface due to the high viscosity ratio, and barring unevenness occurred on the multi-layered coating film.

The comparative example 3 was a case where the difference of the gelatin concentrations and the flow amount ratio satisfied the conditions of the present invention but the viscosity ratio was under the minimum limit of the present invention; in such state, although the ruffles did not occur due to the low viscosity ratio, streaks appeared on the coated surface.

The comparative example 4 was a case where the difference of the gelatin concentrations and the viscosity ratio satisfied the conditions of the present invention but the flow amount ratio was over the maximum limit of the present invention; in such state, although the viscosity ratio was appropriate, mottled unevenness was observed due to the too large flow amount of the coating liquid for the bottom layer.

The comparative example 5 was a case where the difference of the gelatin concentrations and the viscosity ratio satisfied the conditions of the present invention but the flow amount ratio was under the minimum limit of the present invention; in such state, the occurrence of the ruffles was unavoidable due to the too small amount of flow of the coating liquid for the bottom layer. Further, a leveling unevenness along the uneven surface of the web was observed.

In contrast, the examples 1, 2 and 3 were cases where all the difference of the gelatin concentrations, the viscosity ratio, and the flow amount ratio satisfied the conditions of the present invention; in these states, the entrained air effect did not occur, and the multi-layered coated surface of the web was satisfactory.

As described above, in the coating method of the present invention, a coated surface with a satisfactory quality can be attained even though under the conditions that the flow of the multi-layered coating liquid on the slide surface tends to be unstable.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A coating method in which a running web is coated with a plurality of coating liquids by a slide hopper coating apparatus with a slide surface on which the plurality of coating liquids flow down to form a plurality of coating layers on the web, wherein:

at least two of the plurality of coating liquids form a bottom layer and a layer next to the bottom layer with respect to the slide surface, and each of the bottom layer and layer next to the bottom layer contain gelatin;

a gelatin concentration of the coating liquid for the bottom layer is set to be lower than a gelatin concentration of the coating liquid for the layer next to the bottom layer by at least 2 points in percentage by weight; and the plurality of coating liquids are prepared such that a ratio A/B is not less than 0.05 and not more than 0.2 and a ratio C/D is not less than 0.2 and not more than 0.67, where A is a flow amount per width of the coating liquid for the bottom layer on the slide surface, B is a flow amount per width of the whole of the plurality of coating liquids on the slide surface, C is a viscosity of the coating liquid for the bottom layer, and D is a viscosity of the coating liquid for the layer next to the bottom.

2. The coating method as defined in claim 1, wherein the gelatin concentration of the coating liquid for the bottom layer is not less than 3% by weight and not more than 8% by weight.

3. The coating method as defined in claim 1, wherein the slide surface has a portion of a maximum inclination angle of not less than 40 degrees with respect to the level.

4. The coating method as defined in claim 3, wherein the gelatin concentration of the coating liquid for the bottom layer is not less than 3% by weight and not more than 8% by weight.

5. The coating method as defined in claim 3, wherein a length of the portion of the slide surface of the maximum inclination angle of not less than 40 degrees is not more than 10 cm.

6. The coating method as defined in claim 5, wherein the gelatin concentration of the coating liquid for the bottom layer is not less than 3% by weight and not more than 8% by weight.

* * * * *